United States Patent [19]

Galbreath

[11] 3,977,802

[45] Aug. 31, 1976

[54] EXPANSION JOINT AND SEAL

[75] Inventor: Richard N. Galbreath, Richmond, Va.

[73] Assignee: Structural Accessories, Inc., Lenoir, N.C.

[22] Filed: Aug. 4, 1975

[21] Appl. No.: 601,837

[52] U.S. Cl. ..... 404/69; 52/396; 49/475; 14/16.5

[51] Int. Cl.[2] ..... E01C 11/02

[58] Field of Search ..... 404/64, 65, 67, 68, 404/69, 47; 14/16 J; 52/403, 396, 395; 49/475, 482

[56] References Cited

UNITED STATES PATENTS

| | | | |
|---|---|---|---|
| 2,321,873 | 6/1943 | Tate | 52/395 |
| 3,324,774 | 6/1967 | Boschi | 404/47 |
| 3,363,522 | 1/1968 | Galbreath | 404/67 |
| 3,375,763 | 4/1968 | Welch | 14/16 J X |
| 3,410,037 | 11/1968 | Empson | 52/403 X |
| 3,581,450 | 6/1971 | Patry | 52/403 X |
| 3,643,388 | 2/1972 | Parr | 52/403 X |
| 3,713,368 | 1/1973 | McDowell | 404/67 |
| 3,758,220 | 9/1973 | Hein | 404/67 |
| 3,814,530 | 6/1974 | Neff | 404/67 |
| 3,850,539 | 11/1974 | Bowman | 404/69 |

*Primary Examiner*—Nile C. Byers
*Attorney, Agent, or Firm*—Bell, Seltzer, Park & Gibson

[57] ABSTRACT

An expansion joint adapted to overlie and sealingly close an expansion gap between roadway bridge sections or the like and comprising an elastomeric membrane having an upstanding arch disposed across the gap. The arch has a corrugated configuration with the corrugations thereof extending laterally across the gap to impart substantial flexibility to the membrane so as to accommodate relative movement of the roadway sections in each of the vertical, longitudinal, and lateral directions. Side rails overlie the side edges of the membrane and anchor the membrane between the road sections.

17 Claims, 10 Drawing Figures

EXPANSION JOINT AND SEAL

The present invention relates to a roadway expansion joint which is adapted to overlie and seal the expansion gap between closely adjacent roadway sections in bridges, parking decks, overpasses, and other elevated roadways or the like.

It is well recognized that roadways and other building structures may move with respect to their foundations as a result of a number of conditions, including temperature changes, the passage of traffic, or the uneven settling of the foundation. To compensate for this relative movement, roadways and other large structures are constructed in closely adjacent sections which are independently supported for relative movement to thereby define an expansion gap between the sections. In elevated roadways, these gaps commonly extend transversely across the roadway, but in the case of multilane elevated highways or the like, it is common for one or more gaps also to extend in the direction of traffic flow. In addition, the gap may extend at an angle across the road, commonly referred to as a skew angle, where for example, the elevated roadway extends at an angle with respect to the supporting foundation or pilings.

Various expansion joint structures have been proposed for the purpose of providing a substantially uninterrupted road surface across the gap, and to prevent water or debris from falling through the gap onto underlying structures. For example, U.S. Pat. No. 3,713,368 to McDowell et al discloses an elastomeric joint seal which comprises a pair of side pads which are adapted to be secured to the adjacent roadway sections, and an integral arched portion spanning the gap. While such structure has received a degree of commercial success, it has been found that the arched portion of the seal does not provide sufficient flexibility along the direction of the gap, and thus is subject to tearing or rupture when the gap extends along a skew angle. In addition, difficulties are encountered in attempting to install the McDowell joint seal at a curb or the roadway since the arched portion possesses insufficient flexibility to conform to the sharp bends of the curb without rupturing. Finally, the McDowell seal is commercially fabricated in relatively short segments which are joined in an end-to-end arrangement at the job site, and it is common for leaks to develop between these sections.

It is accordingly an object of the present invention to provide an expansion joint and seal which is adapted to extend across the expansion gap between adjacent structural members, and which is characterized by the ability to accommodate substantial relative movement of the structural members in all directions without rupturing or tearing.

It is a more particular object of the present invention to provide a roadway expansion joint which is adapted to provide a substantially uninterrupted road surface across the expansion gap, and which easily conforms to the sharp bends of a curb or the like, such that the joint may extend continuously across the roadway, gutter, and curb without interruption.

It is a further object of the present invention to provide a roadway expansion joint which incorporates an elongate elastomeric sealing membrane of unitary construction through substantially the full longitudinal length of the gap to thereby eliminate the problem of leakage between joined sections and thus achieve watertight integrity.

These and other objects and advantages of the present invention are achieved in the embodiment illustrated herein by the provision of a roadway expansion joint which comprises an elongate elastomeric membrane positioned within opposing channels formed along the adjacent top side edges of the adjacent roadway section, the membrane comprising a pair of relatively flat, substantially co-planar side edges, and an integral upstanding arch positioned intermediate the side edges so as to extend longitudinally along the expansion gap. The arch has a corrugated configuration, with the corrugations thereof extending in a lateral direction with respect to the gap to thereby impart substantial flexibility to the membrane and such that the membrane is able to accommodate relative movement of the roadway sections in each of the vertical, longitudinal, and lateral directions.

A pair of elongate side rails are disposed within the channels and overlie the side edges of the membrane. The side rails define an upper surface which is substantially level with the upper roadway surface, and the rails are anchored to the roadway sections by means of anchor bolts which extend downwardly through the side edges of the membrane and into the associated roadway section.

Some of the objects of the invention having been stated, other objects will appear as the description proceeds, when taken in connection with the accompanying drawing, in which FIG. 1 is an environmental perspective view illustrating adjacent roadway sections of a bridge, and which incorporates an expansion joint and seal embodying the features of the present invention;

Figure 9:
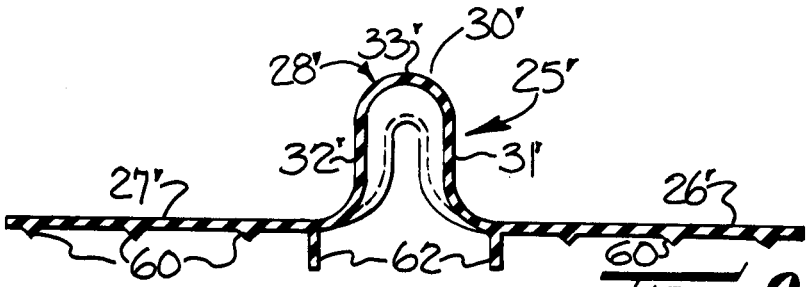
Figure 10:
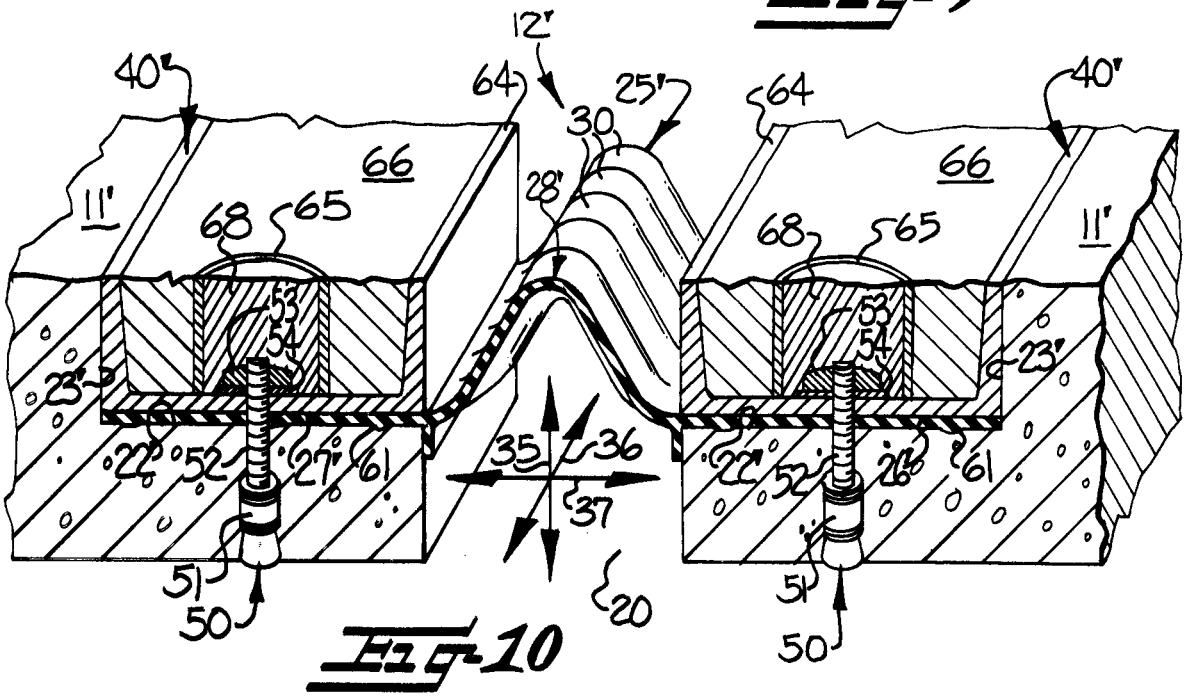

FIG. 9 is an end elevation view of a second embodiment of an elastomeric membrane adapted for use with the present invention; and FIG. 10 is a fragmentary sectioned perspective view of a second embodiment of an expansion joint and seal embodying the features of the present invention and incorporating the elastomeric membrane illustrated in FIG. 9, and with the expansion gap being shown relatively widely separated.

Figure 1:
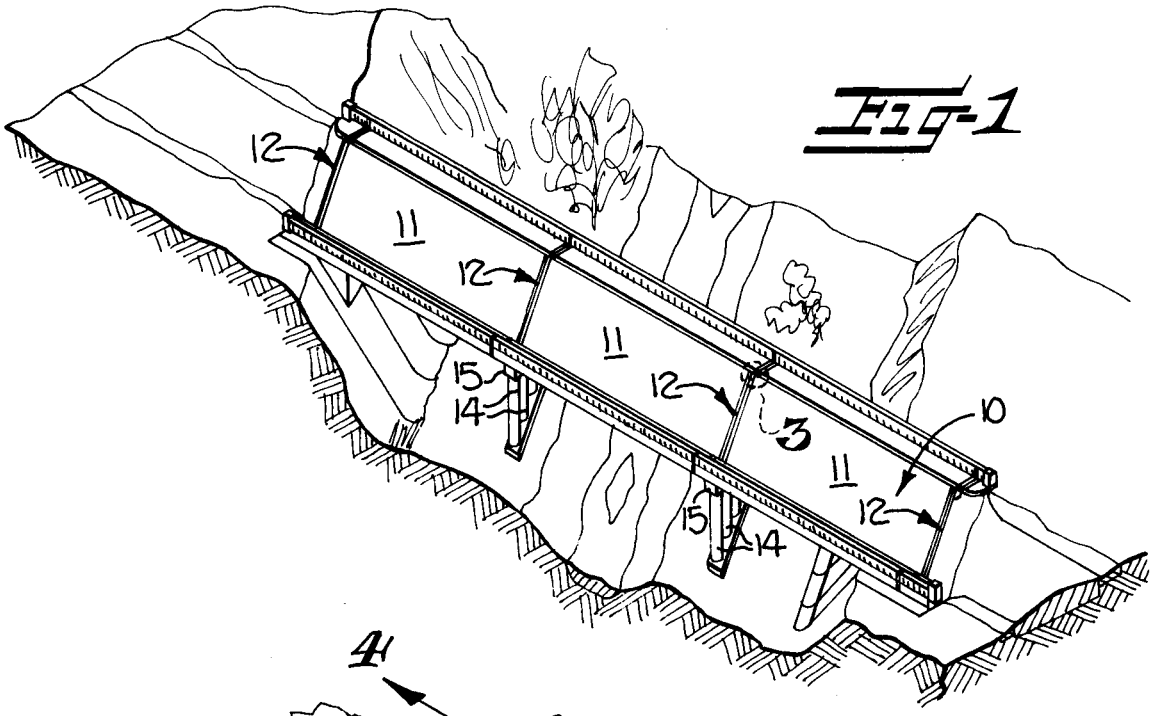
Figure 2:
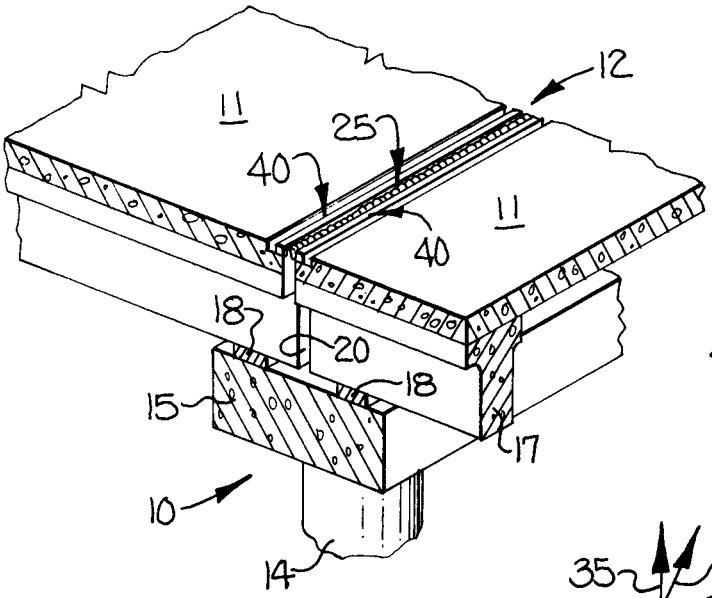
FIG. 2 is an enlarged fragmentary perspective view of a portion of the bridge shown in FIG. 1.

Referring more specifically to the drawings, FIGS. 1 and 2 illustrate a bridge 10 of generally conventional construction, and which comprises a number of roadway sections 11 which are interconnected by an expansion joint and seal 12 which embodies the present invention. More particularly, the bridge 10 comprises a number of rows of aligned foundation columns 14, with each row supporting a lateral top beam 15. Each top beam 15 spans the row of columns, and a number of stringers 17 extend between the adjacent top beams. The stringers are supported for relative movement with respect to the beams by means of suitable bearings 18 which are interposed between each stringer and the underlying top beams. The stringers 17 in turn support slabs of concrete which form roadway section 11, the sections being spaced from each other to define an expansion gap 20.

As noted above, the expansion gap 20 may extend in a direction parallel to the direction of traffic, or perpendicular to the traffic direction, or along an inclined or skew angle. Accordingly, the term "longitudinal" as used herein in describing the orientation of the gap is intended to refer to the long dimension of the gap, and not its orientation with respect to the roadway or traffic direction.

The expansion joint and seal 12 comprises a channel of generally rectangular cross-sectional configuration extending longitudinally along each of the adjacent top side edges of the adjacent roadway sections 11. More particularly, each channel is defined by a lower or bottom surface 22 which is typically about 6 inches wide and a vertical wall 23 which is about two inches high. The channel is preferably formed by employing a suitable form during the pouring of the concrete section, although it may be formed by cutting an existing roadway surface, or by applying a resurfacing layer as hereinafter described.

An elastomeric membrane 25 is positioned within the adjacent channels, and extends longitudinally along and laterally across the gap 20. Preferably, the membrane 25 is of an elongated, unitary construction which extends throughout the full longitudinal length of the gap to thereby achieve a watertight integrity as hereinafter further explained, and thereby eliminate the problem of leakage between joined segments 15 as commonly found in the above-described prior art sealing structures.

Figure 8:
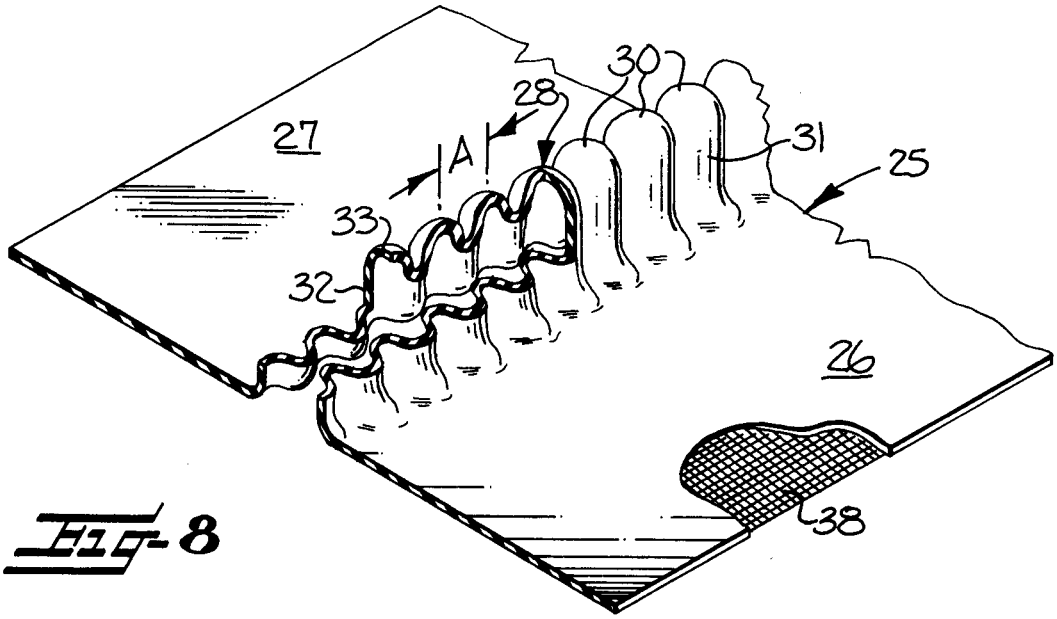
FIG. 8 is a perspective view, partly broken away, of a portion of the elastomeric membrane employed in the joint of FIGS. 1 and 2.

The membrane 25 comprises a pair of relatively flat, substantially co-planar side edges 26 and 27, with each side edge being received in and overlying the lower surface 22 of one of the channels. An integral upstanding arch 28 is positioned intermediate the pair of side edges so as to extend across and longitudinally along the expansion gap 20. As best seen in FIG. 8, the arch 28 has a corrugated configuration with the corrugations 30 thereof being generally rounded and extending in a lateral direction across the gap. More particularly, the arch 28 is of an inverted U-shaped cross-sectional configuration to define substantially vertical side walls 31, 32 and an arcuate top wall 33. The corrugations 30 preferably have a depth between about one-fifth to one-third the height of the arch and extend along substantially the full length of both side walls 31, 32 and the arcuate top wall 33 to define a plurality of rounded, dome-like protuberances.

As a specific non-limiting example, the corrugations have a depth of about one-half inch, and the arch has an overall height of about 2 inches in the relaxed condition. Further, the frequency of the wave form (as produced by the corrugations in vertical cross-section) results in a wave length A (FIG. 8) of about 0.69 inches. By this structure, the wave form of the corrugations includes about 1.74 inches of material for each linear inch of the arch in the longitudinal direction, and this extra material serves to impart substantial flexibility to the membrane 25, and such that the membrane is able to accommodate relative movement of the roadway sections in each of the vertical, longitudinal, and lateral directions (as illustrated by the arrows 35, 36 and 37, respectively in FIGS. 7 and 10).

The membrane 25 is of a substantially uniform thickness of about 3/32 inches throughout both the side edges and the arch, and is preferably molded from a suitable elastomeric material, such as neoprene, natural rubber, or polyvinyl chloride. In addition, a reinforcing fabric 38 may be embedded in the membrane to protect against rupture or tearing. The reinforcing fabric 38 is preferably comprising a somewhat resilient, stretchable material, such as a knit or leno woven fabric, to permit a certain degree of stretchability in the elastomeric membrane and thus further enhance its ability to accommodate relative movement of the roadway sections 11. Also, the fabric is preferably constructed from strong, non-wetting yarns, such as glass or a suitable polymeric material such as nylon or polyester, to prevent deterioration of the fabric in the event of contact with water or moisture.

A longitudinally extending side rail is disposed within each of the channels, and overlies and covers the associated side edge of the membrane 25. Each of the side rails 40 has a generally rectangular cross-sectional configuration substantially conforming to that of the associated channel, and in the embodiment shown in FIGS. 1 – 7, each side rail comprises a flat bottom wall 41 resting upon the membrane side edge, a rear upright wall 42 positioned against the vertical wall 23 of the channel, a front upright wall 43 positioned substantially co-extensive with the gap 20 to form a continuation thereof in the vertical direction, and an intermediate upright wall 44. Further, a horizontal upper wall 45 interconnects the upper ends of the forward and intermediate walls, the upper wall 45 being substantially co-planar with the upper surface of the rear wall 42 and with the roadway surface of the sections 11 so as to form a substantially uninterrupted road surface across the expansion gap. To improve traction, the upper wall 45 may include a number of longitudinally directed grooves 46.

The side rails 40 are preferably fabricated from a suitable metallic material, such as aluminum or steel, and they may be formed in the indicated cross-sectional configuration by an extrusion process, or by welding. Typically, the side rails are fabricated in segments having a longitudinal length of about twenty feet to facilitate handling and shipment, although shorter or longer lengths are possible. The segments are then positioned in a longitudinally extending end-to-end array within the associated roadway channel and along the full length of the expansion gap 20.

To anchor the membrane 25 and side rails 40 within the channels, there is provided a plurality of anchor bolts 50 which are spaced along the longitudinal length of the joint and extend vertically through each of the side rails. The anchor bolts 50 may be cast in place in the case of new construction, or they may be secured into existing concrete by drilling a vertical hole into the bottom surface 22 of the channel, and then inserting a conventional sleeve 51 which is adapted to expand upon receiving the threaded stud 52 therein. The side edges 26, 27 of the membrane and the bottom wall 41 of the side rails 40 are drilled with holes to accommodate the vertical studs 52, and the membrane and side rails are then positioned within the channels as best seen in FIG. 2. Finally, suitable lock washers 53 and nuts 54 are threaded down onto the studs 52 to complete the assembly.

A liquid sealing material may also be employed during the assembly of the joint 12 in order to protect against the incursion of water between the structural members of the joint and the concrete. For example, the bottom surface 22 and side wall 23 of each channel may initially be coated with a suitable mastic sealing material, and an additional layer of sealing material may be applied to the upper surface of the membrane side edges 26, 27 before placing the side rails 40 thereon.

Figure 3:
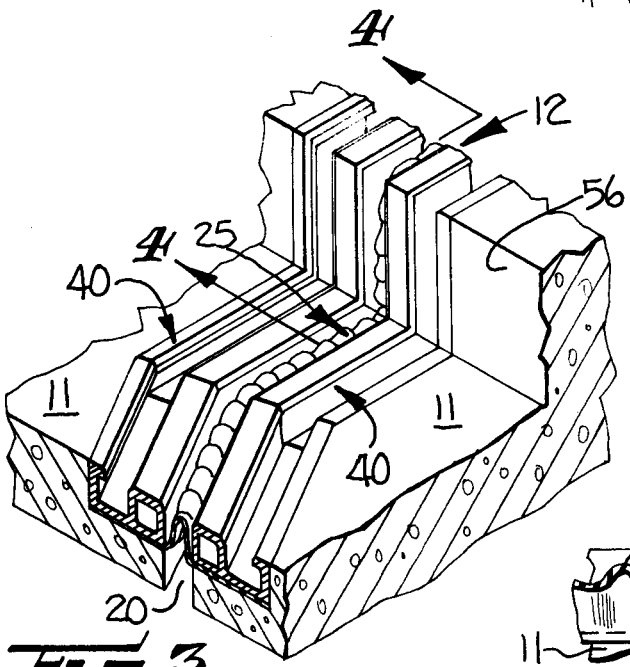
FIG. 3 is an enlarged fragmentary perspective view of a portion of the gutter and curb of the bridge shown in FIG. 1.
Figure 4:
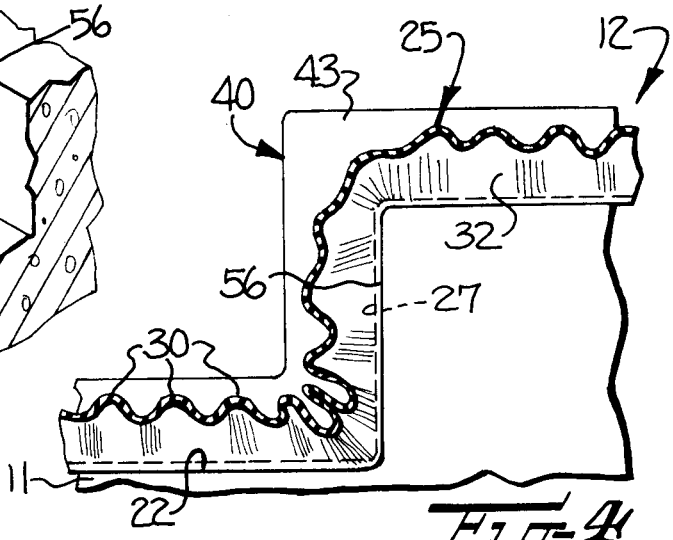
FIG. 4 is a sectional side view taken substantially along the line 4—4 of FIG. 3.
Figure 5:
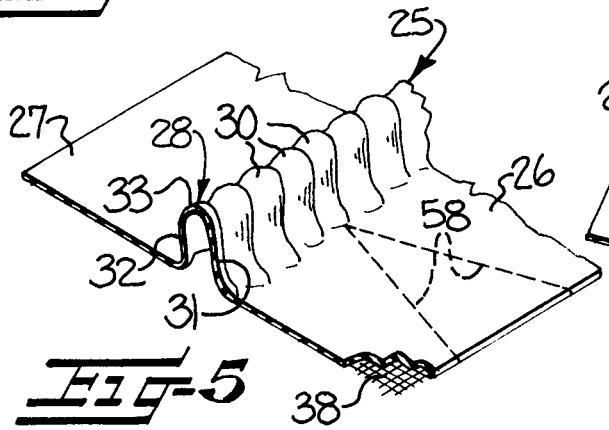
FIGS. 5 and 6 are perspective views of a portion of the membrane of the expansion joint and seal employed in the joint of FIGS. 1 and 2, and illustrate the manner in which the membrane may be curved to follow a skew angle.

In many instances, the gap 20 between the roadway sections 11 extends across the gutter and curb at the sides of the roadway, note FIG. 1. FIGS. 3 and 4 illustrate the manner in which the joint 12 of the present invention is able to traverse a gutter and curb 56 of this type, while maintaining a continuous seal thereacross. More particularly, the membrane 25 is able to flex through 90° at the base of the curb 56 so as to extend vertically up the curb wall, and then flex through 90° in the reverse direction at the top edge of the curb to again extend in the horizontal direction. In this regard, the corrugations 30 of the arch 28 are gathered at the base of the curb as best seen in FIG. 4 to permit the membrane to be folded through 90° without risk of imposing damaging stress to the material in the arch. At the top edge of the curb, the corrugations are separated or spread apart to permit an oppositely directed 90° fold also without danger of tearing or rupturing the material of the arch. Thus the membrane 25 of the present invention is able to be folded through 90° in either direction without danger of tearing or rupturing the arch, and thereby is adapted to extend longitudinally along the full length of the expansion gap 20 and across a gutter and curb 56, without the need to splice separate membrane segments together as is common practice in the prior art. Thus with the present invention, a sealed interconnection across the full length of the roadway gap is assured, and the risk of leakage is substantially precluded.

The side rails 40 of the joint 12 as seen in FIGS. 3 and 4 also extend across the gutter and curb 56, with the ends of the side rails at the curb being suitably beveled so as to form a miter joint at both the base of the curb and the upper edge thereof. The abutting ends of the rails may be welded together if desired.

Figure 6:
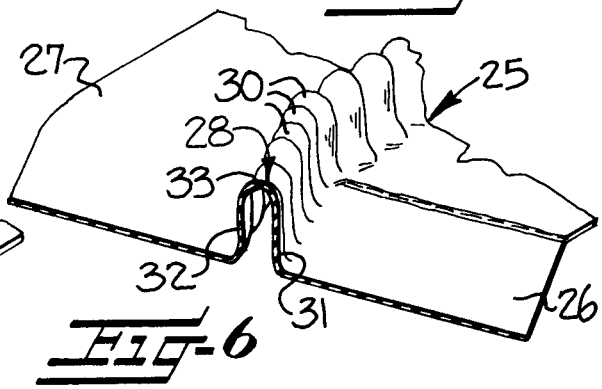

Occasionally, the gap 20 approaches the gutter and curb along a skew angle, and a preferred arrangement for structuring the joint 12 of the present invention to accommodate this contingency is shown in FIGS. 1 and 3. As illustrated, the gap 20 includes a short dog-leg segment which extends perpendicularly outward from the curb 56 for a distance of about one foot, at which point the gap turns into the skew direction. To conform the membrane 25 to this configuration, a pie shaped segment 58 of predetermined size is removed from the inside side edge 26 of the membrane, and the cut edges are then brought together and secured in an abutting relationship as seen in FIG. 6 by a suitable vulcanizing process or the like. The outside side edge 27 and the arch 28 of the membrane are stretched somewhat during this process, and the membrane is thereby able to conform to the angle in the gap without significant risk of loss of the sealing effect. The ends of the side rails 40 are beveled to form a miter joint at the outer end of the dog-leg segment, and the abutting ends may also be welded together to strengthen the joint at this point. Since the joint 12 in the dog-leg segment approaches the curb 56 perpendicularly, it is able to pass thereacross without interruption in its sealing effect in the manner described above.

Where a relatively large angle must be accommodated by the membrane 25 at the point where the skew angle meets the dog-leg section, it may be necessary to transversely cut the side edge 27 to permit the membrane to conform to the angle. An open pie shaped element (not shown) is thereby formed in the edge 27 when the membrane is turned, and in such case, the segment 58 which has been removed from the wide edge 26 may be inserted into the resulting open segment in the side edge 27 and secured therein by vulcanizing or the like.

In some instances, the skew angle of the gap will continue all the way to the curb, thereby eliminating the dog-leg segment illustrated in FIG. 3. In such case, the horizontal rails following the skew angle would be welded or otherwise secured directly to the vertical rails at the curb 56. Since the rails would normally have a different width relationship by reason of the bevel cut, a separate joining plate could be positioned and welded between the two rails to assure a proper interconnection therebetween.

An alternative embodiment of the present invention is illustrated in FIGS. 9 and 10. In this case, the elastomeric membrane 25' includes a number of longitudinally directed wedge shaped integral ribs 60 extending along the lower surface of each side edge 26', 27'. The ribs 60 are compressible, and thus serve to form a number of sealing strips 61 between the membrane and lower surface 22 of the channel when the associated side rail is pressed downwardly by the anchor bolts. This arrangement further serves to guard against the passage of water beneath the joint. In addition, the membrane 25' includes a pair of longitudinally extending, laterally spaced lips 62 which extend downwardly below the lower surface of the side edges as best seen in FIG. 9. Each lip 62 is positioned substantially at the juncture line between the side edge and arch, and is adapted to engage one side edge of the expansion gap 20 to thereby facilitate the initial positioning of the membrane over the gap during the installation of the joint.

The side rails 40' as shown in FIG. 10 each comprise a metal channel member 64 having a substantially U-shaped cross-sectional configuration to define an upwardly facing open receptacle. A cylindrical sleeve 65 is secured, as by welding or the like, in the receptacle about each of the apertures which are provided for receiving the anchor bolts 50, to thereby define an open well. Subsequently the receptacle (but not the wells) is filled with a hardening non-slip grout material 66, such as an epoxy grout having granulated silicone crystals therein which serve to provide an abrasive surface in contact with the tires of the vehicles crossing the joint. The receptacle is filled to a level such that the upper surface of the grout material 66 is substantially level with the upper edges of the metal channel member 64 and the upper roadway surface.

Upon the grout filled metal members 64 being positioned in the roadway channels, and the washer 53 and nut 54 being assembled to each of the anchor bolts 50, a relatively soft, readily removable material 68, such as liquid rubber, is poured into the wells and about the anchor bolts 50. By this arrangement, the anchor bolts may be subsequently reached to facilitate removal of the side rails 40' and replacement of the membrane 25' if the membrane should become accidentally ruptured or damaged during use.

Alternatively, the metal members 64 as illustrated in FIG. 10 could be formed with an upper horizontal wall (not shown) to result in a rail having the form of a rectangular tube in cross-section. The upper wall would then have apertures therein to receive the sleeves 65 which would extend through the tube between the lower and upper walls thereof for the purposes set forth above. This alternative structure would eliminate the need for the grout material 66 since the upper wall of the rail would form a continuation of the upper roadway surface.

Figure 7:
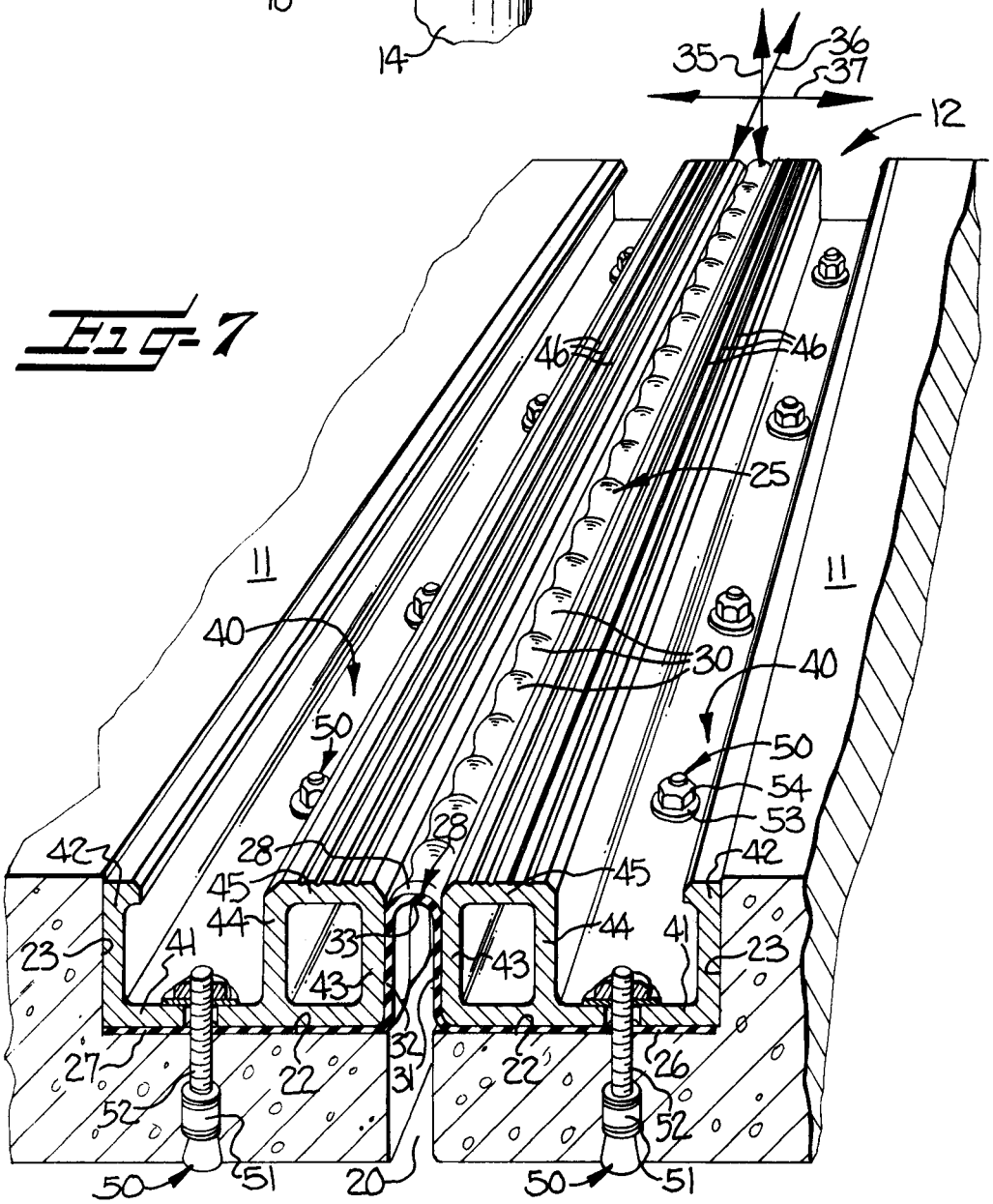
FIG. 7 is a fragmentary sectioned perspective view of the expansion joint and seal as shown in FIGS. 1 and 2, with the expansion gap being shown at its minimal separation.

From the above description, it will be seen that the joint of the present invention is able to accommodate relative movement of the roadway sections in each of the vertical, longitudinal and lateral directions (indicated by the arrows 35, 36 and 37 respectively). Thus, for example, FIG. 7 shows the roadway sections 11 at a minimum gap spacing (typically about 1 inch) while FIG. 10 shows the sections at a maximum gap spacing (typically about 5 inches). Such relative movement is easily accommodated by the flexing of the arch 28 of the membrane. In this regard, it will be noted that the arch of the membrane has a height sufficient to approach but not exceed the vertical height of the side rails 40 so as to not extend above the upper surface of the roadway in use. Thus the arch does not come in contact with the tires of the vehicles passing over the joint. In addition, the fact that the side walls 31, 32 of the arch are inclined with respect to the front walls 43 of the rails results in the automatic expulsion of stones and other incompressibles and debris from the joint during the periodic closing of the gap.

Relative longitudinal or racking movement of the sections (indicated by the arrow 36), which commonly occurs when the gap 20 extends along a skew angle, is also accommodated by the joint 12 of the present invention since the corrugations 30 of the arch provide sufficient excess material in the folds of the dome-shaped corrugations to readily absorb the movement. In other words, shear stresses are substantially eliminated in the arch upon relative longitudinal movement by reason of the fact that there are no plane surfaces in the arch. Similarly, relative vertical movement of the sections will be easily accommodated by the lifting of the one side edge of the arch with respect to the other side edges.

While the present invention has been described for use in connection with concrete roadway sections 11, it will be appreciated that the joint 12 is also adapted for use where the roadway is to be resurfaced with an asphalt layer or the like. In this case, the membrane 25 and side rails 40 would be mounted directly upon the foundation surface for the asphalt, with the vertical height of the side rails conforming to the intended depth of the asphalt layer. The asphalt may then be applied so as to be substantially level with the upper surface of the side rails. As a further alternative configuration, the rails in such resurfacing cases could comprise a simple angle iron of L-shaped cross-section (not shown), with one leg forming a flat bottom wall overlying the side edge of the membrane and the other leg forming a vertical wall which forms a continuation of the gap in the vertical direction. After joining the rails to the foundation surfaces by anchor bolts or the like, the area above the flat bottom walls of the rails would be directly covered with the asphalt to a level conforming to the level of the resurfaced roadway.

In the drawings and specification, there has been set forth a preferred embodiment of the invention, and although specific terms are employed, they are used in a generic and descriptive sense only and not for purposes of limitation.

That which is claimed is:

1. An expansion joint adapted to overlie and sealingly close a longitudinally extending expansion gap between roadway bridge sections or the like, and characterized by the ability to accommodate relative movement of the sections in each of the vertical, longitudinal, and lateral directions, said joint comprising an elongate membrane adapted to be positioned within opposing channels of generally rectangular cross-sectional configuration which extend longitudinally along the adjacent top side edges of the roadway sections, said membrane comprising a. a pair of relatively flat, substantially co-planar, longitudinally extending side edges, with each side edge being adapted to be received in and overlie the lower surface of one of the channels, and b. an integral arch positioned intermediate the pair of side edges so as to be adapted to be disposed within and extend longitudinally along the expansion gap, said arch extending outwardly from the plane of said side edges and having a corrugated configuration with the corrugations thereof extending in a lateral direction to thereby impart substantial flexibility to the membrane such that the membrane is able to accommodate relative movement of the roadway sections in each of the vertical, longitudinal, and lateral directions, a pair of elongate side rails, each of said rails having a cross-sectional configuration which is adapted to be received within and extend longitudinally along one of the roadway channels and overlying the associated membrane side edge, and with the upper surface of the side rails being substantially level with the upper surface of the roadway, and means for anchoring the membrane and side rails within the channels.

2. The expansion joint as defined in claim 1 wherein said arch of said membrane is of an inverted U-shaped cross-sectional configuration to define substantially vertical side walls and an arcuate top wall, and therein said corrugations extend along substantially the full length of said side walls and arcuate top wall.

3. The expansion joint as defined in claim 2 wherein said corrugations have a depth between about one-fifth to one-third the height of said arch.

4. The expansion joint as defined in claim 3 wherein said membrane comprises an elastomeric material having a reinforcing fabric embedded therein.

5. The expansion joint as defined in claim 4 wherein said membrane is of a substantially uniform thickness of about 3/32 inches throughout both said side edges and said arch.

6. The expansion joint as defined in claim 5 wherein said arch of said membrane has a height sufficient to approach but not exceed the vertical height of said side rails so as to not extend above the upper surface of the roadway in use.

7. The expansion joint as defined in claim 6 wherein each of said side edges of said membrane includes at least one rib extending longitudinally along the lower surface thereof, said rib being substantially compressible to effect a sealing strip between the membrane and lower surface of the channel upon the associated side rail and membrane being secured within the channel.

8. The expansion joint as defined in claim 7 wherein said arch of said membrane includes a pair of longitudinally extending, laterally spaced lips extending downwardly below the level of said side edges, with each lip being adapted to engage one side edge of the expansion gap to thereby facilitate the initial positioning of the membrane over the gap.

9. In a roadway comprising closely adjacent roadway sections supported for relative movement with respect to each other and defining a longitudinally extending expansion gap therebetween, the combination therewith of an expansion joint overlying and sealingly closing the expansion gap and characterized by the ability to accommodate relative movement of the sections in each of the vertical, longitudinal, and lateral directions, said joint comprising a channel of generally rectangular cross-sectional configuration extending longitudinally along each of the adjacent top side edges of the adjacent roadway sections, an elastomeric membrane positioned within said channels and extending longitudinally along and laterally across said gap, said membrane comprising a. a pair of relatively flat, substantially co-planar side edges, with each side edge being received in and overlying the lower surface of one of said channels, b. an integral upstanding arch positioned intermediate the pair of side edges so as to extend across and longitudinally along said expansion gap, said arch having a corrugated configuration with the corrugations thereof extending in a lateral direction across said gap to thereby impart substantial flexbility to the membrane such that the membrane is able to accommodate relative movement of said roadway sections in each of the vertical, longitudinal, and lateral directions, a longitudinally extending side rail disposed within each of said channels and overlying the associated membrane side edge, each of said side rails having a generally rectangular cross-sectional configuration substantially conforming to that of the associated channel such that the upper surface of each side rail is substantially level with the upper roadway surface, and means for anchoring said side rails and membrane within said channels.

10. The expansion joint as defined in claim 9 wherein said membrane is of unitary construction throughout substantially the full longitudinal length of said gap.

11. The expansion joint as defined in claim 10 wherein each of said side rails comprises a plurality of individual segments positioned in an end-to-end array.

12. The expansion joint as defined in claim 11, wherein said side rails comprise a metallic material.

13. The expansion joint as defined in claim 12 wherein said side rails comprise a metal member of substantially U-shaped cross-sectional configuration to define an upwardly facing open receptacle, and a non-slip hardened grout material substantially filling said receptacle such that the upper surface of said grout material is substantially level with the upper roadway surface.

14. The expansion joint as defined in claim 9 wherein said anchoring means comprises a plurality of anchor bolts spaced along the longitudinal length of said joint and extending vertically through each of said side rails.

15. An elastomeric membrane adapted to extend across and sealingly close a longitudinally extending expansion gap between adjacent structural members and characterized by the ability to accommodate relative movement between the structural members in each of the vertical, longitudinal, and lateral directions, said membrane comprising a pair of relatively flat, substantially co-planar side edges, and an integral arch positioned intermediate the pair of side edges so as to be adapted to be disposed within and extend longitudinally along the expansion gap, said arch extending outwardly from the plane of said side side edges and having a corrugated configuration with the corrugations thereof extending in a lateral direction to thereby impart substantial flexibility to the membrane such that the membrane is able to accommodate relative movement of the structural members in each of the vertical, longitudinal, and lateral directions.

16. The elastomeric membrane as defined in claim 15 wherein said arch is of an inverted-U-shaped cross-sectional configuration to define substantially vertical side walls and an arcuate top wall, and wherein said corrugations extend along substantially the full length of said side walls and arcuate top wall and have a depth between about one-fifth to one-third the height of said arch.

17. An expansion joint adapted to overlie and sealingly close a longitudinally extending expansion gap between roadway bridge sections or the like, and characterized by the ability to accommodate relative movement of the sections in each of the vertical, longitudinal, and lateral directions, said joint comprising an elongate membrane comprising a pair of relatively flat, substantially co-planar, longitudinally extending side edges, and an integral upstanding arch of U-shaped cross-sectional configuration positioned intermediate the pair of side edges, said arch having a corrugated configuration with the corrugations thereof extending in a lateral direction across the full extent of the arch to thereby impart substantial flexibility to the membrane such that the membrane is able to accommodate relative movement in each of the vertical, longitudinal, and lateral directions, and a pair of elongate side rails, each of said rails having a generally flat bottom wall which is adapted to overlie one of said side edges of the membrane and a vertical wall having a height somewhat greater than that of said arch of said membrane, such that the membrane and side rails may be assembled to overlie the expansion gap between roadway bridge sections or the like by positioning the membrane to overlie the expansion gap, and then positioning the side rails to extend longitudinally along and overlie the side edges of the membrane with the vertical walls of the rails positioned adjacent said arch and forming a continuation of the gap in the vertical direction.

* * * * *

UNITED STATES PATENT AND TRADEMARK OFFICE

CERTIFICATE OF CORRECTION

PATENT NO. : 3,977,802

DATED : August 31, 1976

INVENTOR(S) : Richard N. Galbreath

It is certified that error appears in the above-identified patent and that said Letters Patent are hereby corrected as shown below:

Column 4, Line 13, delete the word "is"; Column 4, Line 23, before "is" insert --40--. Column 6, Line 11, "element" should be --segment--; Column 6, Line 13, "wide" should be --side--. Column 7, Line 50 "edges" should be --edge--. Column 8, Line 48, "therein" should be --wherein--. Column 10, Line 28, delete "-" after "inverted".

Signed and Sealed this

Twenty-third Day of November 1976

[SEAL]

*Attest:*

RUTH C. MASON
*Attesting Officer*

C. MARSHALL DANN
*Commissioner of Patents and Trademarks*